US006358659B1

(12) United States Patent
Foucher et al.

(10) Patent No.: US 6,358,659 B1
(45) Date of Patent: Mar. 19, 2002

(54) COATED CARRIERS

(75) Inventors: Daniel A. Foucher, Toronto; Paula J. MacLeod, Etobicoke; Stephan V. Drappel, Toronto, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/640,457

(22) Filed: Aug. 17, 2000

(51) Int. Cl.[7] ..... A03G 9/113
(52) U.S. Cl. ..... 430/111.35; 430/137.13
(58) Field of Search ..... 430/106.6, 108, 430/111.35, 111.32, 111.33, 137.13

(56) References Cited

U.S. PATENT DOCUMENTS

| | | | | | |
|---|---|---|---|---|---|
| 3,533,835 | A | | 10/1970 | Hagenbach et al. | 117/217 |
| 3,590,000 | A | | 6/1971 | Palermiti | 252/62.1 |
| 3,658,500 | A | | 4/1972 | Hagenbach | 65/21 |
| 3,798,167 | A | | 3/1974 | Kukla et al. | 252/62.1 |
| 3,918,968 | A | | 11/1975 | Kukla et al. | 96/1.5 D |
| 3,922,382 | A | | 11/1975 | Kukla et al. | 427/58 |
| 3,939,086 | A | | 2/1976 | Hagenbach | 252/62.1 P |
| 4,097,617 | A | * | 6/1978 | Datta | 430/108 |
| 4,233,387 | A | | 11/1980 | Mammino et al. | 430/137 |
| 4,238,558 | A | | 12/1980 | Ziolo | 430/108 |
| 4,264,697 | A | | 4/1981 | Perez et al. | 430/107 |
| 4,298,672 | A | | 11/1981 | Lu | 430/108 |
| 4,310,611 | A | | 1/1982 | Miskinis | 430/107 |
| 4,338,390 | A | | 7/1982 | Lu | 430/106 |
| 4,397,935 | A | | 8/1983 | Ciccarelli et al. | 430/110 |
| 4,434,220 | A | | 2/1984 | Abbott et al. | 430/108 |
| 4,560,635 | A | | 12/1985 | Hoffend et al. | 430/106.6 |
| 4,600,677 | A | * | 7/1986 | Hoffend et al. | 430/108 |
| 4,810,611 | A | | 3/1989 | Ziolo et al. | 430/106.6 |
| 4,935,326 | A | | 6/1990 | Creatura et al. | 430/108 |
| 4,937,166 | A | | 6/1990 | Creatura et al. | 430/108 |
| 4,977,054 | A | * | 12/1990 | Honjo et al. | 430/108 |
| 5,002,846 | A | | 3/1991 | Creatura et al. | 430/108 |
| 5,376,494 | A | | 12/1994 | Mahabadi et al. | 430/137 |
| 5,935,750 | A | | 8/1999 | Barbetta et al. | 430/106.6 |
| 5,945,244 | A | | 8/1999 | Barbetta et al. | 430/106.6 |
| 6,004,712 | A | | 12/1999 | Barbetta et al. | 430/108 |
| 6,010,812 | A | | 1/2000 | Barbetta et al. | 430/106.6 |
| 6,037,091 | A | | 3/2000 | MacLeod et al. | 430/106.6 |
| 6,042,981 | A | | 3/2000 | Barbetta et al. | 430/106.6 |

FOREIGN PATENT DOCUMENTS

EP 1 016 933 A2 * 7/2000

OTHER PUBLICATIONS

Alger, Mark S. Polymer Sceince Dictionary. London: Elsevier Applied Science. p. 218 (1989).*

* cited by examiner

*Primary Examiner*—Christopher Rodee
(74) *Attorney, Agent, or Firm*—E. D. Palazzo

(57) ABSTRACT

A carrier with a core and thereover a polymer or mixtures of polymers, and wherein the polymer contains a conductive polymer dispersed therein. Alternatively, the carrier coating can be comprised of a conductive inorganic polymer or a polymer having dispersed therein a conductive inorganic polymer.

24 Claims, No Drawings

COATED CARRIERS

COPENDING APPLICATION AND RELATED PATENTS

Illustrated in U.S. Pat. Nos. 6,042,981; 6,010,812; 6,004,712, and 5,945,244; and 5,935,750, the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in U.S. Pat. No. 5,945,244 a carrier comprised of a core, and thereover a polymer of styrene, an olefin and a dialkylaminoalkyl methacrylate; in U.S. Pat. No. 6,042,981 a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in U.S. Pat. No. 6,010,812 a carrier comprised of a core and a polymer coating of (1) styrene/mono alkylaminoalkyl methacrylate or (2) styrene/dialkylaminoalkyl methacrylate; in U.S. Pat. No. 5,935,750 a carrier comprised of a core and a polymer coating containing a quaternary ammonium salt functionality; and in U.S. Pat. No. 6,004,712, a carrier comprised of a core and thereover a polymer of (1) methylmethacrylate and a monoalkyl aminoalkyl methacrylate, or (2) a polymer of methylmethacrylate and dialkylaminoalkyl methacrylate.

Disclosed in U.S. Pat. No. 6,037,091, the disclosure of which is totally incorporated herein by reference, are carriers containing a ferrocene polymer coating.

Illustrated in copending application U.S. Ser. No. 09/640,601, Coated Carriers, filed concurrently herewith, the disclosure of which is totally incorporated herein by reference, is a carrier comprised of a core, a polymer coating, and wherein said coating contains a conductive polymer.

The appropriate components and processes of the above recited copending applications and patents may be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, solution and preferably by dry powder processes. More specifically, the present invention relates to compositions, especially carrier compositions comprised of a core, and thereover a polymer or polymers, and dispersed therein a conductive component, such as an inorganic polymer like a polyphosphazene, a polysiloxane, a polymetallic nitrile, and the like. Accordingly, in aspects of the present invention there are provided carriers comprised of a core, a polymer, or mixture of polymers thereover, and an inorganic conductive polymer, and which polymer is preferably colorless, and wherein there is enabled carrier particles having excellent conductivity characteristics, that is conductivities that can be preselected and conductivities that are relatively stable over extended time periods. The carrier may also include the polymer coating thereover in admixture with other suitable polymers, and more specifically, a polymer, such as a fluoropolymer, polymethylmethacrylate, poly(urethane), especially a crosslinked polyurethane, such as a poly(urethane)polyester and the like, and wherein the polymer coating contains the inorganic polymer conductive component, and which conductive component is preferably dispersed in the polymer coating. With the conductive component, there can be enabled carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, and the like. An advantage associated with the carriers of the present invention include robust, extended life carriers with lifetimes, for example, of 1,000,000 imaging cycles, a high triboelectrical charge, for example a carrier tribo range of from about a plus (positive charge) 25 to about 100, and more specifically, from about a positive 25 to about a positive 55 microcoulombs per gram, and yet more specifically, from about a positive 30 to about a positive 50 microcoulombs per gram.

The carrier particles of the present invention can be selected for a number of different imaging systems and devices, such as xerographic copiers and printers, inclusive of high speed color xerographic systems, printers associated with computers, digital processes, such as the Xerox Corporation 1090 Marathon, Document Centre 265, the DocuTech series, DocuColor 40, and the like, and wherein monochrome or colored images with excellent and substantially no background deposits are achievable. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected, which charge is dependent, for example, on the polymer composition and the conductive dispersant component applied to the carrier core, and optionally the type and amount of the conductive component selected.

Examples of specific advantages for the carriers of the present invention include in embodiments high robust carrier tribo charge of a positive value, high toner tribo charge of a negative value, excellent admix, for example, from about 1 to about 30 seconds as determined in the known charge spectrograph, increased resistance of the carrier to mechanical aging in a xerographic environment and a decreased sensitivity of the carrier triboelectric value to the relative humidity of the environment, and the like. More specifically, the toner tribo can be, for example, from about a minus 25 to about a minus 100, from about −50 to about −80, or from about −60 to about −70, with corresponding positive tribo charges for the carrier. The tribo can be determined by a number of known methods, such as the use of a Faraday Cage. With respect to high toner tribo charge of a negative value, this property is important to xerographic imaging, especially color applications, primarily because there is enabled development of toner particles into regions of the imaging member, such as a photoreceptor where strong fringe electrical fields exist, that is, at the borders of solids areas and lines. Developing toner particles through these fringe fields minimizes or eliminates the untoned part of the image which appears between two adjacent colors in an image.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, especially at a variety of relative humidities.

Carrier particles for use in the development of electrostatic latent images are described in many patents including, for example, U.S. Pat. No. 3,590,000, the disclosure of which is totally incorporated herein by reference. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where a portion of, or the entire coating may separate from the carrier core in the form of, for example, chips or flakes, and which resulting carrier can fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low triboelectrical values.

There is illustrated in U.S. Pat. No. 4,233,387, the disclosure of which is totally incorporated herein by reference, coated carrier components comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of, for example, from about 25 to about 75 weight percent, such halides including copper iodide, copper fluoride, and mixtures thereof. Also, in U.S. Pat. No. 5,002,846, the disclosure of which is totally incorporated herein by reference, there is illustrated a carrier with polymer coatings thereover. The appropriate components and processes of the '846, '166 and '326 patents may be selected for the present invention in embodiments thereof.

When resin coated carrier particles are prepared by powder coating process, the majority of the coating materials are fused to the carrier surface thereby reducing the number of toner impaction sites on the carrier. Additionally, there can be achieved with the process of the present invention and the carriers thereof, independent of one another, desirable triboelectric charging characteristics and conductivity values; that is, for example, the triboelectric charging parameter is not dependent on the carrier coating weight. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities as determined in a magnetic brush conducting cell of from about $10^{-6}$ (ohm-cm)$^{31\ 1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, and high carrier triboelectric charging values of from about 20 to about 100, and, for example, from a positive about 45 to a positive about 90 microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles.

Other U.S. Patents that may be of interest include U.S. Pat. No. 3,939,086, which illustrates steel carrier beads with polyethylene coatings, see column 6; U.S. Pat. Nos. 4,264,697; 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY

It is a feature of the present invention to provide toner and developer compositions with carrier particles containing polymer coatings.

In another feature of the present invention there are provided dry coating processes for generating carrier particles of substantially constant conductivity parameters, and excellent core/polymer adhesion.

In yet another feature of the present invention there are provided carrier particles possessing substantially constant conductivity parameters, and high triboelectric charging values.

In yet a further feature of the present invention there are provided carrier particles with high tribo values of at least about 30 microcoulombs per gram, and wherein the coating contains therein a polymer conductive component, wherein the polymer Tg is, for example, from about −20° C. to about 120° C. and preferably from about 60° C. to about 0° C., and which component possesses a conductivity of from about positive 25 to about 60 microcoulombs per gram, and preferably from about positive 30 to about 50 microcoulombs per gram, excellent mobility, and where the polymer is preferably colorless, or substantially colorless. Aspects of the present invention relate to a carrier comprised of a core and thereover a polymer or mixture of polymers, and wherein the polymer contains a conductive inorganic polymer dispersed therein; a carrier comprised of a core and an inorganic conductive polymer; a carrier wherein the conductive polymer is a polyphosphazene; a carrier wherein the conductive polymer is a polymetallonitrile; a carrier wherein the conductive polymer is a polysiloxane containing conductive pendant groups; a carrier wherein the conductive polymer is a polyphosphazene of poly(bis (methoxyethoxyethoxy)phosphazene (1), poly(phenyl (methoxy ethoxyethoxy)phosphazene (2), poly(methyl (methoxy ethoxyethoxy)phosphazene (3), poly(methoxy (methoxyethoxyethoxy)phosphazene (4), poly(phenoxy (methoxyethoxy ethoxy)phosphazene (5), poly (methylamino(methoxyethoxyethoxy)phosphazene (6), poly (phenylamino(methoxyethoxyethoxy)phosphazene (7), poly (bis(methoxyethoxy)phosphazene (8), poly(bis (methoxypropoxy)phosphazene (9), poly(bis-β-pentafluroethylpropoxy)phosphazene (10), poly (bisphenoxy)phosphazene (11), poly(bis-β-trifluoromethylethoxy)phosphazene (12), poly(bis-4 -phenylphenoxy)phosphazene (13), poly(bis[1,1]biphenyl-4-methoxy-4'-ethoxyethoxyethoxy)phosphazene (14), or poly(bismethoxy)phosphazene (15); a carrier wherein the conductive polymer is a polyphosphazene of poly[bis-4-isopropylphenoxy)phosphazene] (16), poly(2-methoxyethoxy ethoxycarbo-4,4-methoxyethoxyethoxy-6, 6-methoxyethoxyethoxy)phosphazene (17), poly(2-methoxyethoxyethoxy-thio-4,4-methoxy ethoxyethoxy-6,6-methoxy ethoxyethoxy)phosphazene (18), poly(2-methoxyethoxyethoxythionyl-4,4-methoxyethoxyethoxy-6, 6-methoxy ethoxyethoxy)phosphazene (19), or (poly (methoxyethoxyethoxy)oxothiazene (20); a carrier wherein the conductive polymer is a polysiloxane of poly[(2-(2-(2-methoxyethoxy)ethoxy)-ethoxy)propyl alkyl siloxane] (21), poly[methyl(2-(2-(2-methoxyethoxy)ethoxy)-ethoxy)propyl alkyl siloxane] (22), poly[ethyl(2-(2-(2-methoxyethoxy) ethoxy)-ethoxy)propyl alkyl siloxane] (23), poly[propyl(2-(2-(2-methoxyethoxy)ethoxy)-ethoxy)propyl alkyl siloxane] (24), poly[phenyl(2-(2-(2-methoxyethoxy)ethoxy)-ethoxy) propyl alkyl siloxane] (25), or poly[methyl(2-(2-(2-methoxyethoxy)ethoxy)-ethoxy)-ethoxy)-ethoxy)-ethoxy)-ethoxy) propyl alkyl siloxane] (26); a carrier wherein the conductive polymer possesses an $M_w$ weight average molecular weight of from about 5,000 to about 1,000,000, and of an $M_n$ number average molecular weight of from about 12,000 to about 1,000,000; a carrier wherein the conductive polymer coating weight thereof is from about 0.1 to about 20 weight percent, or wherein the conductive polymer coating weight is from about 1 to about 3 weight percent; a carrier wherein the conductive polymer possesses a glass transition temperature Tg of from about 120° C. to about 200° C., or wherein the conductive polymer Tg is from about 60° C. to about 80° C.; a carrier wherein the conductive polymer is selected in an amount of from about 10 to about 60 weight percent; a carrier wherein the core is a metal, a metal oxide, or a ferrite; a carrier with a triboelectric charge of from about a positive 30 to about a positive 100 microcoulombs per gram; a carrier with a triboelectric charge of from about a positive 50 to about a positive 70 microcoulombs per gram; a developer comprised of the carrier illustrated herein and toner; a developer wherein the toner is comprised of thermoplastic resin and colorant; a developer wherein the colorant is a pigment and the resin is a styrene copolymer, or a polyester; a developer comprised of (1) a carrier core and coating layer of a conductive polymer, and a polymer, and (2) a toner; a developer wherein the carrier core is selected from the group consisting of iron, ferrites, steel and nickel; a developer with a carrier triboelectric charge of from about a positive 30 to about a positive 100 microcoulombs per gram, and a toner triboelectric charge of from about a negative 30 to about a negative 100 microcoulombs per gram; a developer with a carrier triboelectric charge of from about a positive 60 to about a positive 70 microcoulombs per gram, and a toner triboelectric charge of from about a negative 60 to about a negative 70 microcoulombs per gram; a carrier wherein the conductive polymer possesses a conductivity of from about $1\times10^{-5}$ to about $1\times10^{-9}$; a carrier wherein the carrier contains a further polymer coating, or mixtures of polymers; a carrier wherein polymer is a styrene acrylate, a styrene methacrylate, a fluoropolymer, or a polyurethane, and which polyurethane optionally contains dispersed therein conductive components; a carrier wherein the further coating is comprised of a polyurethane/polyester; a carrier and which carrier possesses a conductivity of from about $1\times10^{-5}$ to about $1\times10^{-9}$; an imaging process which comprises developing an image with the developer illustrated herein; a process for the preparation of the carrier of the present invention by the dry mixing and heating of the core, the coating and the conductive polymer; a carrier wherein the polymer possesses a weight average molecular weight of from about 15,000 to about 500,000, and number average molecular weight $M_n$ of from about 7,000 to about 220,000; a carrier wherein the core is powdered steel, or a strontium ferrite, and wherein the carrier is of an average diameter of from about 50 to about 125 microns; a carrier comprised of a core, a polymer coating, and wherein the polymer coating contains a conductive polymer; a carrier wherein the carrier contains a further polymer coating; a carrier wherein the second coating is comprised of a polyurethane, and which polyurethane optionally contains dispersed therein conductive components; a carrier wherein the polymer is a polyurethane/polyester, a styrene based polymer, a polymethylmethacrylate, or a fluorocarbon polymer; a carrier wherein the polymer is a styrene based polymer; a carrier wherein the polymer is polymethylmethacrylate; a carrier wherein the polymer is a styrene based polymer; a carrier wherein the polymer is polymethylmethacrylate; a carrier wherein the conductive polymer is

1

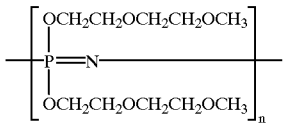

2

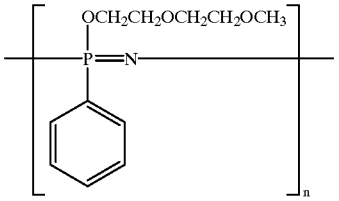

3

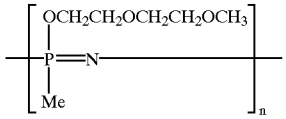

4

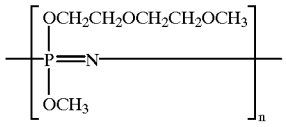

-continued
6
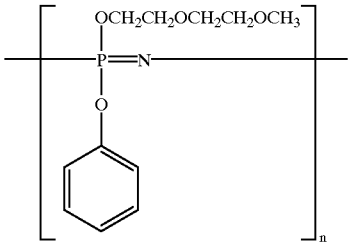
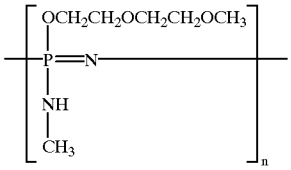
7
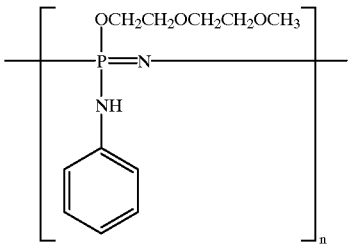
8
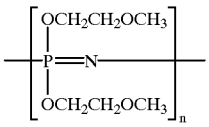
9
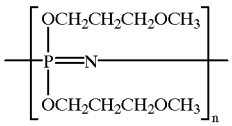
10
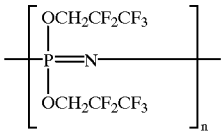
11
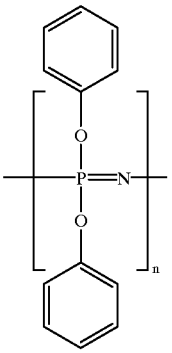
-continued
12
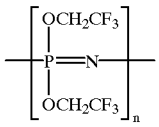
13
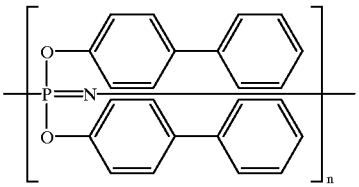
14
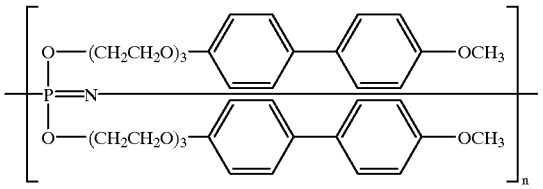
15
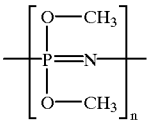
16
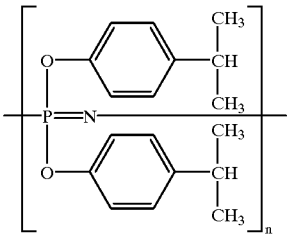
17
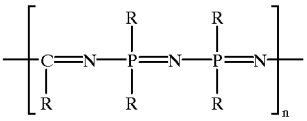
where R = $(OCH_2CH_2)_2OCH_3$
18
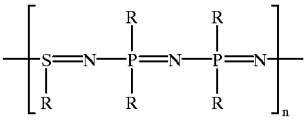
where R = $(OCH_2CH_2)_2OCH_3$
19
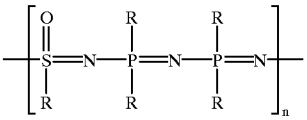
where R = $(OCH_2CH_2)_2OCH_3$
20
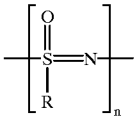
where R = $(OCH_2CH_2)_2OCH_3$ -continued

21

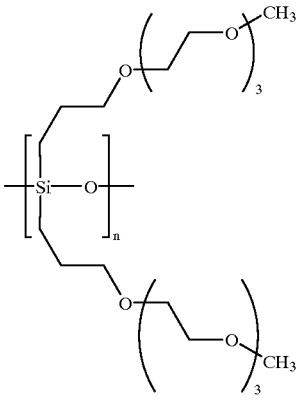

22

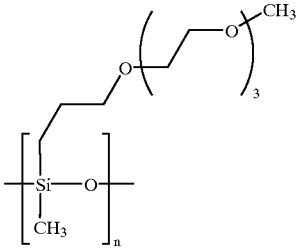

23

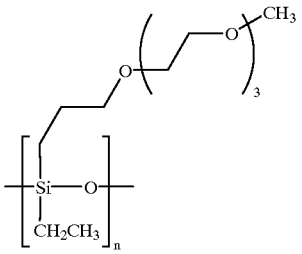

24

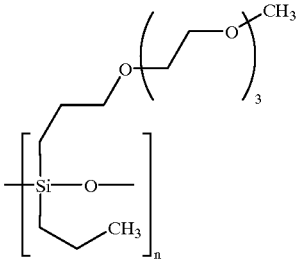

25

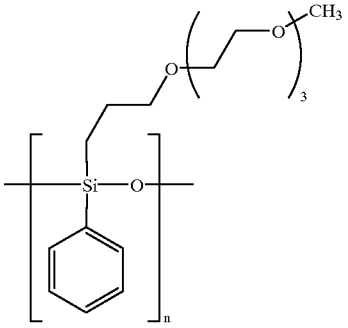

-continued

26

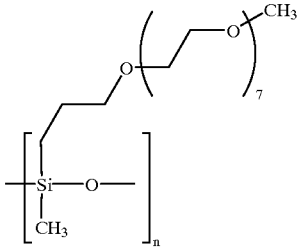

and wherein n represents the number of repeating segments; a carrier comprised of a core and a coating of a polymer

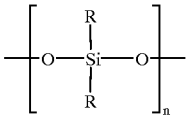

Polysiloxanes

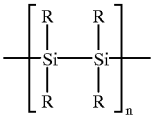

Polysilanes

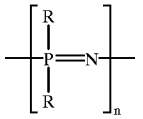

Polyphosphazenes

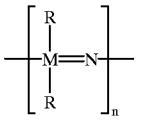

Polymetallonitrile and wherein R is alky, aryl, or alkoxy; M is a metal, and n represents the number of segments; and carrier wherein the conductive polymer is

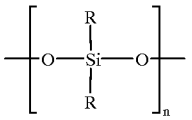

Polysiloxanes

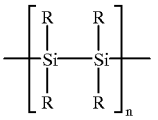

Polysilanes

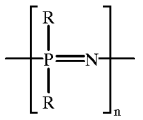

Polyphosphazenes

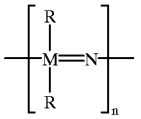

Polymetallonitrile and wherein R is alkyl, aryl, or alkoxy; M is a metal, and n represents the number of segments; a carrier wherein the conductive polymer is generated by the reaction of a mixture of monomers to provide a copolymer or homopolymer of the conductive polymer, and the polymer formed from the monomer; a carrier wherein the copolymer is a polyphosphazene polymethylmethacrylate, or a polysiloxane polymethylmethacrylate; a carrier wherein the copolymer is a heteropolyphosphazene polymethylmethacrylate; a carrier comprised of a core, and thereover an organic polymer inclusive of crosslinked polymers generated, for example, from (1) homopolymers of polyphosphazenes, polysiloxanes, and polymetallonitriles (2) copolymers of polyphosphazenes, polysiloxanes, polynitriles or polymetallonitriles with acrylates, methacrylates, aminoacrylates, styrenes and combinations thereof, (3) or blends of polyphosphazenes, polysiloxanes, polynitriles or polymetallonitriles with acrylates, methacrylates, aminoacrylates, styrenes other suitable vinyl monomers, and mixtures thereof, and the like, and wherein the carrier polymer contains from 1 to about 25 noncarbon atoms with respect to homopolymers and blends, and between 1 to about 25 noncarbon atoms for other polymers; a carrier wherein each of the alkyls in the polymer independently contains from 1 to about 6 carbon atoms; a carrier wherein the polymer coating is crosslinked, with a crosslink density of between about 0.0001 and about 0.1, preferably between about 0.001 and about 0.01 and where the crosslink density refers, for example, to the number of polymer to polymer chemical bonds (crosslinks) divided by the total number of monomeric units in the polymer; that is, 0.01 crosslink density represents one crosslink per 100 monomer units; copolymers of t-butylaminoethyl methacrylate, and an oxirane, or epoxy, such as glycidyl methacrylate, or a copolymer of an amine and haloalkylmethylstyrenes; a carrier wherein the crosslinked copolymer coating contains from about 5 to 20 mole percent of an aminoalkyl methacrylate and from about 5 to about 20 mole percent of an epoxy component, with the balance of the polymer composed of nonamino and nonepoxy monomers such as methylmethacrylate; a carrier wherein the copolymer coating possesses an $M_w$ of from about 20,000 to about 900,000, or greater than about 1,000,000, for example, about 1,000,000 to about 3,000,000 and of an $M_n$ of from about 12,000 to about 350,000, or greater than about 1,000,000, for example, about 1,000,000 to about 3,000,00; a carrier wherein the polymer coating is a crosslinked copolymer generated from an amino compound, such as vinyl polymers with primary or secondary amine groups, and epoxide groups on the same polymer, and the coating weight thereof is from about 0.1 to about 20 weight percent; a carrier wherein the polymer coating weight is from about 1 to about 3 weight percent; a carrier wherein the polymer coating contains a conductive component; a carrier wherein the conductive component is a polymer; a carrier wherein the conductive component is selected in an amount of from about 10 to about 60 weight percent; a carrier wherein the core is a metal, a metal oxide, or a ferrite; a carrier with a triboelectric charge of from about a positive 50 to about a positive 100 microcoulombs per gram; a carrier with a triboelectric charge of from about a positive 50 to about a positive 70 microcoulombs per gram; a developer comprised of a coated carrier and toner; a developer wherein the toner is comprised of thermoplastic resin and colorant; a developer wherein the colorant is a pigment and the toner resin is a styrene copolymer, or a polyester; a developer comprised of a (1) carrier core and coating layer of a polymer containing a conductive polymer, and (2) a toner; a developer wherein the carrier core is selected from the group consisting of iron, ferrites, steel and nickel; a developer with a carrier triboelectric charge of from about a positive 60 to about a positive 70 microcoulombs per gram, and a toner triboelectric charge of from about a negative 60 to about a negative 70 microcoulombs per gram; a carrier wherein the carrier contains a first and second polymer coating, and an inorganic component, and more specifically, an inorganic polymer; a carrier wherein the first and/or second coating is comprised of a styrene acrylate, a styrene methacrylate, or a fluoropolymer; a carrier wherein the second coating is comprised of a polyurethane and which polyurethane optionally contains dispersed therein conductive components; a carrier wherein the second coating is comprised of a polyurethane/polyester with a conductive polymer optionally dispersed therein; carrier particles prepared by mixing low density porous magnetic, or magnetically attractable metal core carrier particles with from, for example, between about 0.05 percent and about 3 percent by weight, based on the weight of the coated carrier particles, of certain polymers, and which polymer may contain dispersed therein a polymer that is conductive, until adherence thereof to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

As the carrier coating, there can be included in addition to the first polymer and the inorganic conductive polymer a polymer as illustrated herein, and more specifically for example, a fluorocarbon, polymethylmethacrylate (PMMA), a thermosetting polymer, such as a thermosetting polyurethane, a polyester, a styrene based polymer, or a second nitrogen-containing copolymer, and wherein the first polymer is selected in an amount of from about 1 to about 100, or from about 10 to about 75 weight percent, based on the total weights of all polymers and conductive components present in the carrier and the second polymer is selected in an amount of from about 99 to about 0, or from about 90 to about 25 weight percent, based on the total weights of all polymers and conductive component present in the carrier; and wherein the carrier core is a metal, a ferrite, a metal oxide, and the like, inclusive of known carrier cores. Preferably the second polymer is PMMA, a thermosetting polyurethane, and the like inclusive of suitable known polymers.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and further wherein the carrier cores possess desirable mechanical aging characteristics; and for example, a suitable core surface morphology to permit high electrical conductivity of the developer comprising the carrier and a suitable toner. Examples of specific carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, about 19 percent zinc oxide, and about 70 percent iron oxide and available from D.M. Steward Corporation or Powdertech Corporation, Ni/Zn-ferrite available from Powdertech Corporation, Sr (strontium)-ferrite, containing, for example, about 14 percent strontium oxide and 86 percent iron oxide and available from Powdertech Corporation, Ba-ferrite, magnetites, available, for example, from Hoeganaes Corporation (Sweden), nickel, mixtures thereof, and the like. Preferred carrier cores include ferrites, and sponge iron, or steel grit with an average particle size diameter of, for example, from between about 30 microns to about 400 microns, and preferably from about 50 to about 50 microns.

Examples of first polymer coatings include polyvinylfluorides, polyvinylidene fluorides, styrene acrylates, styrene methacrylates, siloxanes, polyferrocenes, the polymers and copolymers of the pending applications and patents recited herein, and the like.

The process for incorporating the polymer onto a carrier core can be sequential, a process in which one of two polymers, when two polymers are selected, is fused to the surface in a first step and the second polymer is fused to the surface in a subsequent fusing operation. Alternatively, the process for incorporation can comprise a single fusing.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, and the like, including those as illustrated in a number of the patents recited herein, and other effective known charge agents or additives. The charge additives are selected in various effective amounts, such as from about 0.05 to about 15, and from about 0.1 to about 3 weight percent, based, for example, on the sum of the weights of polymer, conductive additive, and charge additive components. The addition of various known charge enhancing additives can act to further increase the triboelectric charge imparted to the carrier, and therefore, further increase the negative triboelectric charge imparted to the toner in, for example, a xerographic development subsystem.

Examples of further, especially second, polymers selected can include polymonoalkyl methacrylates or acrylates, polyurethanes, fluorocarbon polymers such as polyvinylidenefluoride, polyvinylfluoride, and polypentafluorostyrene, polyethylene, polyethylene-co-vinylacetate, polyvinylidenefluoride-co-tetrafluoroethylene, and the like, inclusive of other known suitable polymers. Other known related polymers not specifically mentioned herein may also be selected, such as those illustrated in the U.S. Pat. Nos. 4,937,166 and 4,935,326 patents mentioned herein.

A specific second polymer is comprised of a thermosetting polymer and yet, more specifically, a poly(urethane) thermosetting resin which contains, for example, from about 75 to about 95, and more specifically, about 80 percent by weight of a polyester polymer, which when combined with an appropriate crosslinking agent, such as isopherone diisocyannate and initiator, such as dibutyl tin dilaurate, forms a crosslinked poly(urethane) resin at elevated temperatures. An example of a polyurethane is poly(urethane)/polyester polymer or Envirocron (product number PCU10101, obtained from PPG Industries, Inc.). This polymer possesses a melt temperature of between about 210° F. and about 266° F., and a crosslinking temperature of about 345° F. This second polymer is mixed together with the first copolymer polymer, generally prior to mixing with the core, which when fused forms a uniform coating of the first and second polymers on the carrier surface. The second polymer is present in an amount of from about 0 percent to about 99 percent by weight, based on the total weight of the first and second polymers and the polymer conductive component.

Examples of conductive carrier coating polymers include polyphosphazene polymers such as poly(bis(methoxyethoxyethoxy)phosphazene (1), commercially available as MEEP, poly(phenyl(methoxyethoxyethoxy) phosphazene (2), poly(methyl methoxy ethoxyethoxy) phosphazene (3), poly(methoxy(methoxyethoxyethoxy) phosphazene (4), poly(phenoxy(methoxyethoxyethoxy) phosphazene (5), poly(methylamino(methoxyethoxyethoxy) phosphazene (6), poly(phenylamino(methoxyethoxyethoxy) phosphazene (7), poly(bis(methoxy ethoxy)phosphazene (8), poly(bis(methoxypropoxy)phosphazene (9), poly(bis-β-pentafluoroethylpropoxy)phosphazene (10), poly (bisphenoxy)phosphazene (11), poly(bis-β-trifluoromethylethoxy)phosphazene (12), poly(bis-4-phenylphenoxy)phosphazene (13), poly(bis[1,1]biphenyl-4-methoxy-4'-ethoxyethoxyethoxy)phosphazene (14), poly (bismethoxy)phosphazene (15), poly[bis-4-isopropylphenoxy)phosphazene] (16), poly(2-methoxyethoxyethoxycarbo-4,4-methoxyethoxyethoxy-6,6-methoxyethoxy ethoxy)phosphazene (17), poly(2-methoxyethoxyethoxy-thio-4,4-methoxy ethoxyethoxy-6,6-methoxyethoxy ethoxy)phosphazene (18), poly(2-methoxyethoxyethoxythionyl-4,4-methoxy ethoxyethoxy-6,6-methoxyethoxy ethoxy)phosphazene (19), (poly (methoxyethoxyethoxy)oxothiazene (20), poly[(2-(2-(2-methoxyethoxy)ethoxy)-ethoxy)propyl alkyl siloxane] (21), poly[methyl(2-(2-(2-methoxyethoxy)ethoxy)-ethoxy)propyl alkyl siloxane] (22), poly[ethyl(2-(2-(2-methoxyethoxy) ethoxy)-ethoxy)propyl alkyl siloxane] (23), poly[propyl(2-(2-(2-methoxyethoxy)ethoxy)-ethoxy)propyl alkyl siloxane] (24), poly[phenyl(2-(2-(2-methoxyethoxy)ethoxy)-ethoxy) propyl alkyl siloxane] (25), poly[methyl(2-(2-(2-methoxyethoxy)ethoxy)-ethoxy)-ethoxy)-ethoxy)-ethoxy)-ethoxy)propyl alkyl siloxane] (26), or in embodiments mixtures thereof, reference for example the following Formulas 1 to 26 wherein n represents the number of repeating segments, such as, for example, from about 5 to about 100,000, and more specifically about 50,000, and Me is methyl; and those of the following four formulas

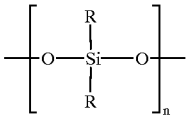

Polysiloxanes

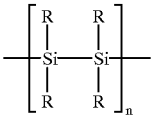

Polysilanes

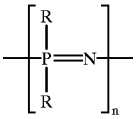

Polyphosphazenes

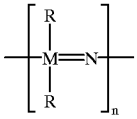

Polymetallonitrile wherein R is a suitable group, such as alkyl, aryl like phenyl, amino(alkylamino) like amino(methyl amino)alkoxy, and the like, and preferably for the siloxanes R is alkyl, aryl, or amino(alkyl amino), and for the phosphazenes and metallonitriles R is preferably alkoxy like methoxy, methoxyethoxyether and the like, and alkyl; M is a metal, and n represents the number of segments, and more specifically, about 5 (oligomers) to about 50,000, from about 100 to about 10,000 and in embodiments preferably from about 20 to about 10,000. Alkyl and alkoxy can contain from 1 to about 25 carbon atoms, and aryl can contain from about 6 to about 30 carbon atoms.

The number of segments n for the formulas illustrated herein is, for example, a number that provides a suitable polymer, which number can be, for example, from about 5 to about 100,000 or greater in embodiments.

1
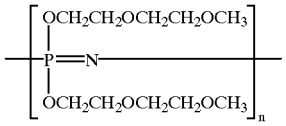
2
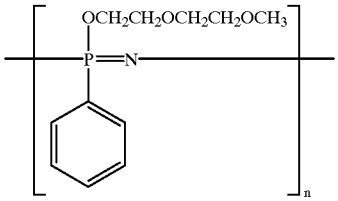
3
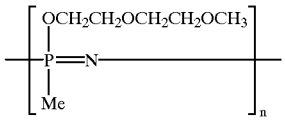
4
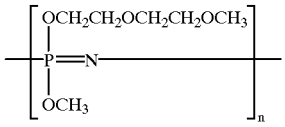
5
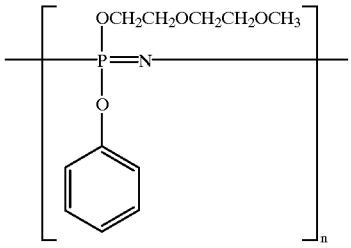
6
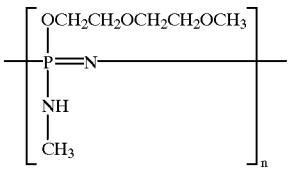
7
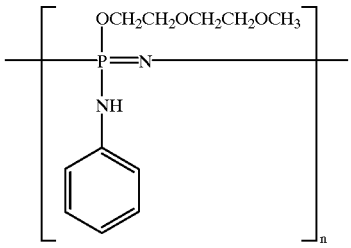
8
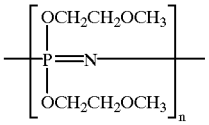
-continued
9
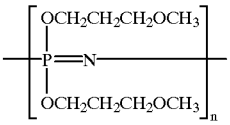
10
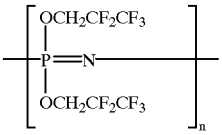
11
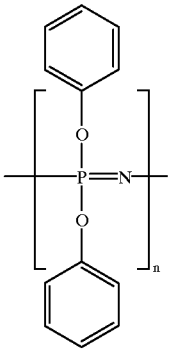
12
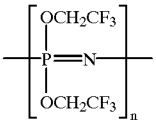
13
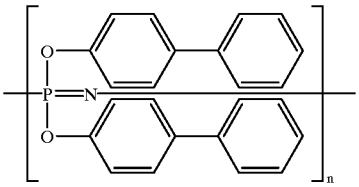
14
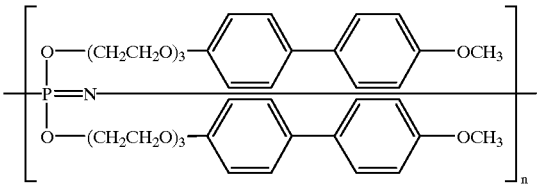
15
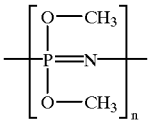

-continued

16

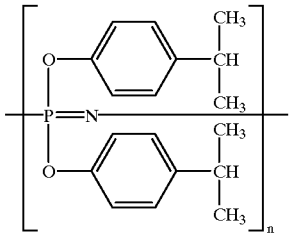

17

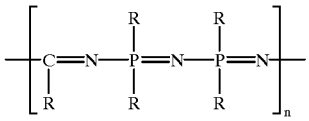

where R = $(OCH_2CH_2)_2OCH_3$

18

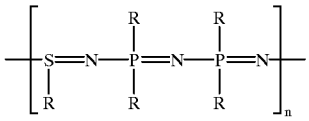

where R = $(OCH_2CH_2)_2OCH_3$

19

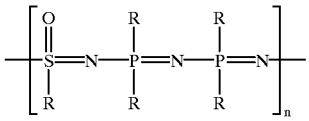

where R = $(OCH_2CH_2)_2OCH_3$

20

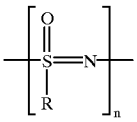

where R = $(OCH_2CH_2)_2OCH_3$

21

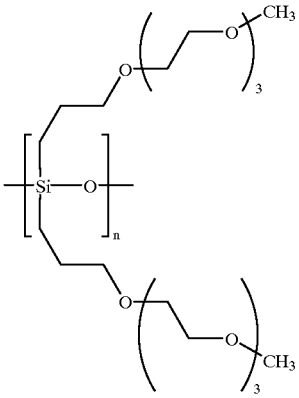

22

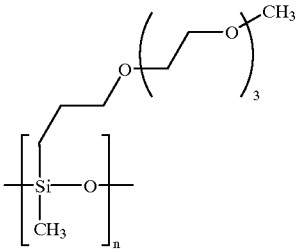

-continued

23

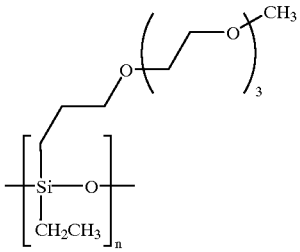

24

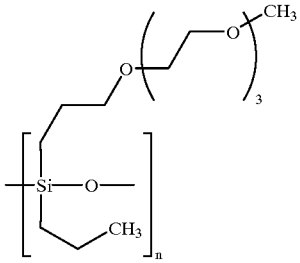

25

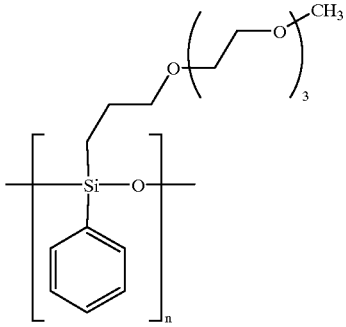

26

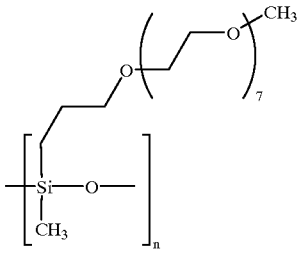

The inorganic components, and more specifically, the inorganic polymers inclusive of homopolymers, copolymers, and graft copolymers can be present on the carrier as the only coating in embodiments; can be present together with a mixture of polymer coatings, such as a first and second coating; can be selected as a conductive component in place of, for example, conductive carbon blacks; wherein in embodiments the inorganic component is comprised of a polymer or polymers that have incorporated therein inorganic elements into the polymer backbone, and wherein the inorganic polymers, such as the polysiloxanes, polyphosphazenes, or polysilanes, can be modified at either the monomer or macromolecular stage to provide conductive or high conductive pendant groups.

Generally, the conductive inorganic polymers possess glass transitions (Tg) in the range of about 120° C. to about 200° C., and preferably between about 60° C. and about 80° C., and conductivities in the range of about $10^{-3}$ to about $10^{-8}$, and preferably from about $10^{-4}$ to about $10^{-7}$. Conductive polyphosphazenes, polyhetrophosphazenes, and polysiloxanes with high Tgs, such as greater than >50° C., can be used directly as carrier coatings, whole conductive materials with lower Tgs, <50° C., are preferably used as blends. Conductive polyphosphazenes and polyhetero phosphazenes are typically prepared in research quantities, 5 grams to 1 kilograms quantities, at Penn State University or at the University of Toronto using methods developed by the Allcock and Manners Laboratories, respectfully, while poly (alkyl/aryloxothiazenes) have been prepared in small quantities by Roy and others at the Dow Corning Corporation.

Various effective suitable processes can be selected to apply the polymer, or mixtures thereof, for example from 2 to about 5 polymers, and preferably two, polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with the carrier generates developer compositions, such binders including styrene based resins, styrene acrylates, styrene methacrylates, styrene butadienes, polyamides, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated monoolefins, such as ethylene, propylene, butylene and isobutylene; vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments, dyes, or mixtures thereof, and more specifically, pigments can be selected as the colorant for the toner particles including, for example, carbon black, nigrosine dye, lamp black, iron oxides, magnetites, and mixtures thereof, known cyan, magenta, yellow pigments, and dyes. The colorant should be present in a sufficient amount to render the toner composition highly colored. Thus, the colorant can be present in amounts of, for example, from about 1 percent by weight to about 20, and preferably from about 5 to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, Pigment Blue 15:3, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like, inclusive of dyes thereof can be selected. These colorants are generally present in the toner composition in an amount of from about 1 weight percent to about 15, and for example, from about 2 to about 12 weight percent based on the weight of the toner components of binder and colorant. Examples of dyes include known dyes, such as food dyes and the like.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

For further enhancing the charging characteristics of the developer compositions described herein, and as optional components, lo there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and for example, from about 3 to about 12 percent by weight. These charge additives can also be dispersed in the carrier polymer coating as indicated herein.

The toner compositions can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the colorant are spray dried under controlled conditions to result in the desired product. Toner particles sizes and shapes are known and include, for example, a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990, 4,585,884, 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images, obtained with the developer compositions of the present invention in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are being provided to further illustrate the present invention, it being noted that these Examples are intended to illustrate and not specifically limit the scope of the present invention. Parts and percentages are by weight unless otherwise indicated. The carrier triboelectric charge is as recited. When not recited, this charge was from about 50 to about 75 microcoulombs per gram, it is believed.

Synthetic Example I

Preparation of Polyphosphazenes for use as Homopolymers, Blends or Additives in Carrier Coatings from Thermal Ring-Opening Polymerization Polyphosphazenes containing alkyl, aryl, alkoxy, or aryloxy pendant groups are generally prepared from the polymeric intermediate polydichlorophosphazene which in turn can be readily prepared from the thermal ring opening of hexachlorophosphazene or hexafluorocyclo triphosphazene at 250° C. A general known synthetic procedure is outlined below:

To a neat sample of hexachlorocyclotriphosphazene, 99 percent (100 grams, 0.402 mol) is added a small amount of a suitable Lewis acid initiator such as $BCl_3$ (0.005 gram, $4.0\times10^{-4}$ mol) in a sealed ampoule that is heated to 250° C. for 3 to 4 hours or until the melt becomes immobile. The sealed ampoule is cooled, broken, and dissolved in 200 milliliters of dichloromethane. The monomeric material is separated by precipitation into an excess of hexanes. The polymer is recovered as a dry, hydroscopic powder that should not be exposed to air for long periods of time. The polymer is readily redissolved in solvents like dioxane and can be substituted with any appropriate alkyl, aryl lithium or Grignard reagent, aryl or alkyl alkoxy metal salt, or any number of amino pendant groups, wherein n and R are as indicated herein.

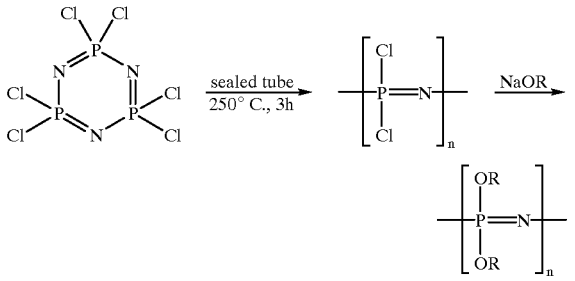

Synthetic Example II

Preparation of Polyphosphazenes for use as Homopolymers, Blends or Additives in Carrier Coatings at Room Temperature from Lewis Acid Catalyzed Polymerization of Phosphoranimine Alternatively, the above same intermediate polymer can be prepared through a living cationic room temperature route involving the catalytic reaction of phosphorus pentachloride with trichloro(trimethylsilyl)phosphoranimine or related materials as illustrated by Manners et al., referenced herein.

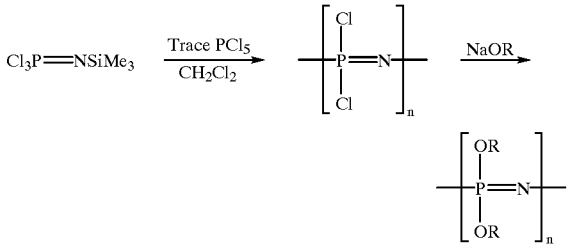

A mixture of freshly distilled phosphoranimine (50 grams, 0.223 mol) and a small amount of phosphorous pentachloride (250 milligrams, $1.2\times10^{-4}$ mol) are added to a large glass ampoule and sealed under vacuum. The mixture is allowed to stand at room temperature, about 25° C., for between 3 to 4 days. The clear mixture forms two phases (the elimination of chlorotrimethylsilane) over this period and is deemed complete. The resulting solution is evaporated to dryness and redissolved in dioxane. The polymer can be substituted with any appropriate alkyl, aryl lithium or Grignard reagent, aryl or alkyl alkoxy metal salt, or any number of amino pendant groups.

Several other possible routes to polyphosphazenes exist, including those described by Harry Allcock of Penn State University, Krzysztof Matyjaszewski of Carnegie Mellon University, Patty Wisian-Neilson of Southern Methodist University and Robert Neilson of Texas Christian University.

Synthetic Example III

Synthesis of Conductive Polysiloxanes

Synthesis of poly[bis(2-(2-(2-methoxyethoxy)ethoxy)-ethoxy)propylsiloxane] 21 (as taught by West et al., *Organometallics,* 17, 1999, 3249) for use as blends or additives in carrier coating can be prepared as follows:

The siloxane polymer, 21, is prepared with the addition of the dichlorosilane (40 grams, 0.1 mol solution in xylene) to a solution containing triethylene glycol allyl methyl ether (41.12 grams, 0.2 mol) and a THF solution of chloroplatinic acid (20 $\mu$mol) at 0° C. The mixture resulting was heated at 60° C. for 12 hours, after which time the solvents were removed to reveal a dark brown oil, which was redissolved in dichloromethane and precipitated into hexanes and recovered as the above polymer product in an 80 percent yield of a slightly colored oil.

Synthetic Example IV

Synthesis of the single combined polymer, poly[methyl (2-(2-(2-methoxyethoxy)ethoxy)-ethoxy)propyl alkyl siloxane] (as taught by West et al., *Organometallics,* 17, 1999, 3249) for use as blends or additives in carrier coating can be prepared as follows:

The single siloxane polymer, 22, is prepared with the addition of the poly(methylhydrosiloxane) (40 grams, 0.67 mol solution in xylene) to a solution containing heptaethylene glycol allyl methyl ether (237.6 grams, 6.6 mol) and a THF solution of chloroplatinic acid (660 $\mu$mol) at 0° C. The mixture was heated at 60° C. and refluxed for 12 hours, after which time the solvents were removed in vacuo. The polymer was further purified by rinsing repeatedly in hexanes. A clear oil polymer product was recovered in a 95 percent yield.

Melt Preparation of Polyphosphazene Homopolymer Carrier

EXAMPLE I

A carrier coated with poly(phenylamino (methoxyethoxyethoxy)phosphazene (7) is prepared as follows:

In the first step of the carrier coating process, 3 grams of poly(phenylamino(methoxyethoxyethoxy)phosphazene homopolymer (7) prepared as in either Synthetic Example I or Synthetic Example II and 190 grams of 77 micron volume median diameter irregular steel core (obtained from Hoeganaes), with the core size determined in this and all following carrier examples by a standard laser diffraction technique are mixed in a 250 milliliter plastic bottle. The mixing is accomplished with a hand shaker for a period of 45 minutes. There resulted uniformly distributed and electrostatically attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the above polymer, with the weight percent of the poly(phenylamino (methoxyethoxyethoxy)phosphazene (7) as determined in this and all following carrier examples by dividing the difference between the weights of the fused carrier and the carrier core by the weight of the fused carrier.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles, which is about a positive 75 microcoulombs per gram, can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Solution Preparation of Polyphosphazene Homopolymer Carrier

EXAMPLE II

A carrier coated with poly(phenylamino (methoxyethoxyethoxy) phosphazene (7) was prepared as follows:

In the first step of the carrier coating process, 3 grams of poly(phenylamino(methoxyethoxyethoxy)phosphazene homopolymer (7) prepared as in either Synthetic Example I or Synthetic Example II and 190 grams of 77 micron volume median diameter irregular steel core (obtained from Hoeganaes), with the core size determined in this and all following carrier Examples by a standard laser diffraction technique and 100 milliliters of ACS grade dichloromethane (Aldrich) are mixed in a 250 milliliter plastic bottle. The mixing is accomplished with a hand shaker for a period of 45 minutes. There results a uniform distribution of the attached polymer on the core as determined by visual observation. In the second step, the dichloromethane mixture containing the polymer and the carrier beads, with continuous air stirring, are brought to dryness by vacuum evaporation. This results in a continuous uniform polymer coating on the core. The final product is comprised of a carrier core with a total of approximately 90 percent surface coverage of the carrier core by the polymer, with the weight percent of the poly(phenylamino(methoxyethoxyethoxy) phosphazene (7) determined by dividing the difference between the weights of the fused carrier and the carrier core by the weight of the fused carrier.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles, about 80 microcoulombs per gram, can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to $10^{-8}$ $(\text{mho-m})^{-1}$. Therefore, these carrier particles would be considered conductive.

Melt Preparation of Polyphosphazene Homopolymer Carrier

EXAMPLE III

A carrier coated with poly(bis[1,1]biphenyl-4-methoxy-4'-ethoxyethoxyethoxy)phosphazene (14) is prepared as follows:

In the first step of the carrier coating process, 3 grams of poly(bis[1,1 ]biphenyl-4-methoxy-4-ethoxyethoxyethoxy) phosphazene homopolymer (14) prepared as in either Synthetic Example I or Synthetic Example II and 190 grams of 77 micron volume median diameter irregular steel core (obtained from Hoeganaes), with the core size being determined by a standard laser diffraction technique, are mixed in a 250 milliliter plastic bottle. The mixing is accomplished with a hand shaker for a period of 45 minutes. There results uniformly distributed and electrostatically attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the poly(bis[1,1]biphenyl-4-methoxy-4'-ethoxyethoxyethoxy)phosphazene homopolymer (14).

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge of about 80 microcoulombs per gram on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ $(\text{mho-cm})^{-1}$. Therefore, these carrier particles would be considered conductive.

Solution Preparation of Polyphosphazene Homopolymer Carrier

EXAMPLE IV

A carrier coated with poly(bis[1,1]biphenyl-4-methoxy-4'-ethoxyethoxyethoxy)phosphazene (14) is prepared as follows:

In the first step of the carrier coating process, 3 grams of a carrier coated with the above polymer as prepared in either Synthetic Example I or Synthetic Example II and 190 grams of 77 micron volume median diameter irregular steel core (obtained from Hoeganaes), with the core size determined in this and all following carrier examples by a standard laser diffraction technique, and 100 milliliters of ACS grade dichloromethane (Aldrich) are mixed in a 250 milliliter plastic bottle. The mixing is accomplished with a hand shaker for a period of 45 minutes. There results a uniform distribution of the attached polymer on the core as determined by visual observation. In the second step, the dichloromethane mixture containing the polymer and the carrier beads, with continuous air stirring, are brought to dryness by vacuum evaporation. This results in a continuous uniform polymer coating on the core. The final product is comprised of a carrier core with a total of approximately 90 percent surface coverage of the carrier core by the polymer, with about 2 weight percent of the poly(bis[1,1]biphenyl-4-methoxy-4'-ethoxyethoxyethoxy)phosphazene (14).

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ $(\text{mho-cm})^{-1}$. Therefore, these carrier particles would be considered conductive.

Melt Preparation of Blended Polyphosphazene/ MMA Polymer Carrier

EXAMPLE V

A carrier coated with 50:50 poly(bis[1,1]biphenyl-4-methoxy-4'-ethoxyethoxyethoxy)phosphazene (14) polymethylmethacrylate is prepared as follows:

In the first step of the carrier coating process, 1.5 grams of poly(bis[1,1]biphenyl-4-methoxy-4'-ethoxyethoxyethoxy)phosphazene homopolymer (14) as prepared in either Synthetic Example I or Synthetic Example II and 1.5 grams of polymethylmethacrylate polymer along with 190 grams of 77 micron volume median diameter irregular steel core (obtained from Hoeganaes), with the core size determined in this and all following carrier Examples by a standard laser diffraction technique, are mixed in a 250 milliliter plastic bottle. The mixing was accomplished with a hand shaker for a period of 45 minutes. There resulted uniformly distributed and electrostatically attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymer, with the weight percent of the blended polymers, poly(bis[1,1]biphenyl-4-methoxy-4'-ethoxyethoxyethoxy)phosphazene homopolymer (14) and polymethylmethacrylate calculated as in carrier coating Example I, and being, it is believed, about 1.75 percent.

A developer composition can then prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Solution Preparation of Blended Polyphosphazene/ MMA Polymer Carrier

EXAMPLE VI

A carrier coated with a blend of poly(bis[1,1]biphenyl-4-methoxy-4'-ethoxyethoxyethoxy)phosphazene (14) and polymethyl methacrylate is prepared as follows:

In the first step of the carrier coating process, 1.5 grams of poly(bis[1,1]biphenyl-4-methoxy-4'-ethoxyethoxyethoxy)phosphazene homopolymer (14) as prepared in either Synthetic Example I or Synthetic Example II and 1.5 grams of polymethylmethacrylate polymer along with 190 grams of 77 micron volume median diameter irregular steel core (obtained from Hoeganaes), with the core size being determined by a standard laser diffraction technique and 100 milliliters of ACS grade dichloromethane (Aldrich), are mixed in a 250 milliliter plastic bottle. The mixing was accomplished with a hand shaker for a period of 45 minutes. There results a uniform distribution of the attached polymer on the core as determined by visual observation. In the second step, the dichloromethane mixture containing the polymer and the carrier beads, with continuous air stirring, were brought to dryness by vacuum evaporation. This results in a continuous uniform polymer coating on the core. The final product is comprised of a carrier core with a total of approximately 90 percent surface coverage of the carrier core by the polymer, with the weight percent of the blended polymers, poly(bis[1,1]biphenyl-4-methoxy-4'-ethoxyethoxyethoxy)phosphazene (14) and polymethylmethacrylate calculated as in the above carrier coating Example I.

A developer composition can then be prepared by mixing 200 rams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Melt Preparation of Blended Polyphosphazene/ MMA Polymer Carrier

EXAMPLE VII

A carrier coated with 50:50 of poly(bis-β-trifluoromethyl ethoxy)phosphazene (12)/polymethylmethacrylate is prepared as follows:

In the first step of the carrier coating process, 1.5 grams of poly(bis-β-trifluoromethylethoxy)phosphazene (12) as prepared in either Synthetic Example I or Synthetic Example II and 1.5 grams of polymethylmethacrylate polymer along with 190 grams of 77 micron volume median diameter irregular steel core (obtained from Hoeganaes), with the core size being determined by a standard laser diffraction technique, were mixed in a 250 milliliter plastic bottle. The mixing is accomplished with a hand shaker for a period of 45 minutes. There results uniformly distributed and electrostatically attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymer, with the weight percent of the blended polymers, of poly(bis-β-trifluoromethylethoxy)phosphazene (12) and polymethyl methacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Solution Preparation of Blended Polyphosphazene/ MMA Polymer Carrier

EXAMPLE VIII

A carrier coated with a blend of poly(bis-β-trifluoromethylethoxy)phosphazene (12) and polymethylmethacrylate was prepared as follows:

In the first step of the carrier coating process, 1.5 grams of poly(bis-β-trifluoromethylethoxy)phosphazene (12) as prepared in either Synthetic Example I or Synthetic Example II and 1.5 grams of polymethylmethacrylate polymer along with 190 grams of 77 micron volume median diameter irregular steel core (obtained from Hoeganaes), with the core size determined by a standard laser diffraction technique and 100 milliliters of ACS grade dichloromethane (Aldrich), are mixed in a 250 milliliter plastic bottle. The mixing is accomplished with a hand shaker for a period of 45 minutes. There results a uniform distribution of the attached polymer on the core as determined by visual observation. In the second step, the dichloromethane mixture containing the polymer and the carrier beads, with continuous air stirring, are brought to dryness by vacuum evaporation. This results in a continuous uniform polymer coating on the core. The final product is comprised of a carrier core with a total of approximately 90 percent surface coverage of the carrier core by the polymer of poly(bis-β-trifluoromethylethoxy) phosphazene (12) and polymethylmethacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Melt Preparation of Polyphosphazene Additive in a PMMA Polymer Carrier

EXAMPLE IX

A carrier coated with 3:97 ratio of poly(bis(methoxy ethoxyethoxy)phosphazene (1 )/polymethylmethacrylate is prepared as follows:

In the first step of the carrier coating process, 0.09 gram of poly(bis(methoxyethoxyethoxy)phosphazene (1) as prepared in either Synthetic Example I or Synthetic Example II and 2.91 grams of polymethylmethacrylate polymer along with 190 grams of 77 micron volume median diameter irregular steel core (obtained from Hoeganaes), with the core size being determined by a standard laser diffraction technique, are mixed in a 250 milliliter plastic bottle. The mixing is accomplished with a hand shaker for a period of 45 minutes. There results uniformly distributed and electrostatically attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymers of poly(bis(methoxyethoxyethoxy) phosphazene (1) and polymethylmethacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Solution Preparation of Polyphosphazene Additive in a PMMA Polymer Carrier

EXAMPLE X

A carrier coated with 3:97 ratio of poly(bis(methoxy ethoxyethoxy)phosphazene (1)/polymethylmethacrylate is prepared as follows:

In the first step of the carrier coating process, 0.09 gram of poly(bis(methoxyethoxyethoxy)phosphazene (1) as prepared in either Synthetic Example I or Synthetic Example II and 2.91 grams of polymethylmethacrylate polymer along with 190 grams of 77 micron volume median diameter irregular steel core (obtained from Hoeganaes), with the core size being determined by a standard laser diffraction technique and 1 00 milliliters of ACS grade dichloromethane (Aldrich), are mixed in a 250 milliliter plastic bottle. The mixing is accomplished with a hand shaker for a period of 45 minutes. There results a uniform distribution of the attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymers, with the weight percent of the blended polymers, of poly(bis(methoxyethoxyethoxy)phosphazene (1) and polymethyl methacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Melt Preparation of Blended Polyheterophosphazene/MMA Polymer Carrier

EXAMPLE XI

A carrier coated with 50:50 of poly(2-methoxyethoxy ethoxycarbo-4,4-methoxyethoxyethoxy-6,6-methoxyethoxy ethoxy)phosphazene (17)/polymethylmethacrylate is prepared as follows:

In the first step of the carrier coating process, 1.5 grams of poly(2-methoxyethoxyethoxycarbo-4,4-methoxyethoxyethoxy-6,6-methoxy ethoxyethoxy) phosphazene (17) prepared by ring-opening polymerization reactions of the parent inorganic ring molecule under conditions similar to those in Synthetic Example I and 1.5 grams of polymethylmethacrylate polymer together with 190 grams of 77 micron volume median diameter irregular steel core (obtained from Hoeganaes), are mixed in a 250 milliliter plastic bottle. The mixing is accomplished with a hand shaker for a period of 45 minutes. There results uniformly distributed and electrostatically attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymers with the weight percent of the blended polymers, of poly(2-methoxyethoxyethoxycarbo-4,4-methoxyethoxyethoxy-6,6-methoxyethoxy thoxy) phosphazene (17) and polymethylmethacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Solution Preparation of Blended Heteropolyphosphazene/PMMA Polymer Carrier

EXAMPLE XII

A carrier coated with a blend poly(2-methoxyethoxy ethoxycarbo-4,4-methoxyethoxyethoxy-6,6-methoxyethoxy ethoxy)phosphazene (17) and polymethylmethacrylate is prepared as follows:

In the first step of the carrier coating process, 1.5 grams of poly(2-methoxyethoxyethoxycarbo-4,4-methoxyethoxyethoxy-6,6-methoxy ethoxyethoxy) phosphazene (17) prepared by ring-opening polymerization reactions of the parent inorganic ring molecule under conditions similar to those in Synthetic Example I and 1.5 grams of polymethylmethacrylate polymer along with 190 grams of 77 micron volume median diameter irregular steel core (obtained from Hoeganaes), and 100 milliliters of ACS grade dichloromethane (Aldrich) are mixed in a 250 milliliter plastic bottle. The mixing is accomplished with a hand shaker for a period of 45 minutes. There results a uniform distribution of the attached polymer on the core as determined by visual observation. In the second step, the dichloromethane mixture containing the polymer and the carrier beads, with continuous air stirring, were brought to dryness by vacuum evaporation. This results in a continuous uniform polymer coating on the core. The final product is a comprised of a carrier core with a total of approximately 90 percent surface coverage of the carrier core by the polymer, of poly(2-methoxyethoxyethoxycarbo-4,4-methoxyethoxyethoxy-6,6-methoxyethoxy ethoxy) phosphazene (17) and polymethylmethacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Melt Preparation of Polyheterophosphazene Additive in an MMA Polymer Carrier

EXAMPLE XIII

A carrier coated with 3:97 ratio of poly(2-methoxyethoxy ethoxycarbo-4,4-methoxyethoxyethoxy-6,6-methoxyethoxyethoxy) phosphazene (17)/polymethylmethacrylate is prepared as follows:

In the first step of the carrier coating process, 0.09 gram of poly(2-methoxyethoxyethoxycarbo-4,4-methoxyethoxyethoxy-6,6-methoxy ethoxyethoxy) phosphazene (17) prepared by ring-opening polymerization reactions of the parent inorganic ring molecule under conditions similar to those in Synthetic Example I and 2.91 grams of polymethylmethacrylate polymer together with 190 grams of 77 micron volume median diameter irregular steel core (obtained from Hoeganaes) are mixed in a 250 milliliter plastic bottle. The mixing is accomplished with a hand shaker for a period of 45 minutes. There results uniformly distributed and electrostatically attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymer, with the weight percent of the blended polymers, of poly(2-methoxyethoxyethoxycarbo-4,4-methoxyethoxyethoxy-6,6-methoxyethoxy ethoxy) phosphazene (17) and polymethylmethacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Solution Preparation of Heteropolyphosphazene Additive in an PMMA Polymer Carrier

EXAMPLE XIV

A carrier coated with 3:97 ratio of poly(2-methoxyethoxyethoxycarbo-4,4-methoxyethoxyethoxy-6,6-methoxyethoxy ethoxy)phosphazene (17)/polymethylmethacrylate is prepared as follows:

In the first step of the carrier coating process, 0.09 gram of poly(2-methoxyethoxyethoxycarbo-4,4-methoxyethoxyethoxy-6,6-methoxy ethoxyethoxy) phosphazene (17) prepared by ring-opening polymerization reactions of the parent inorganic ring molecule under conditions similar to those in Synthetic Example I and 2.91 grams of polymethylmethacrylate polymer along with 190 grams of 77 micron volume median diameter irregular steel core (obtained from Hoeganaes), with the core size being determined by a standard laser diffraction technique and 100 milliliters of ACS grade dichloromethane (Aldrich), are mixed in a 250 milliliter plastic bottle. The mixing is accomplished with a hand shaker for a period of 45 minutes. There results a uniform distribution of the attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymer, with the weight percent of the blended polymers, of poly(2-methoxyethoxyethoxycarbo-4,4-methoxyethoxyethoxy-6,6-methoxyethoxyethoxy) phosphazene (17), and polymethylmethacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Melt Preparation of Blended Polysiloxane/MMA Polymer Carrier

EXAMPLE XV

A carrier coated with 50:50 of poly[bis(2-(2-(2-methoxyethoxy)ethoxy)-ethoxy)propylsiloxane] (21)/polymethylmethacrylate is prepared as follows:

In the first step of the carrier coating process, 1.5 grams of poly[bis(2-(2-(2-methoxyethoxy)ethoxy)-ethoxy) propylsiloxane] (21) prepared as in Synthetic Example III and 1.5 grams of polymethylmethacrylate polymer along with 190 grams of 77 micron volume median diameter irregular steel core (obtained from Hoeganaes) are mixed in a 250 milliliter plastic bottle. The mixing is accomplished with a hand shaker for a period of 45 minutes. There results uniformly distributed and electrostatically attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymers, with the weight percent of the blended polymers, of poly[bis(2-(2-(2-methoxyethoxy)

ethoxy)-ethoxy)propylsiloxane] (21) and polymethyl methacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Solution Preparation of Blended Polysiloxane/ MMA Polymer Carrier

EXAMPLE XVI

A carrier coated with a blend of poly[bis(2-(2-(2-methoxyethoxy)ethoxy)-ethoxy)propylsiloxane] (21) and polymethyl methacrylate is prepared as follows:

In the first step of the carrier coating process, 1.5 grams of poly[bis(2-(2-(2-methoxyethoxy)ethoxy)-ethoxy) propylsiloxane] (21), prepared as in Synthetic Example II and 1.5 grams of polymethylmethacrylate polymer along with 190 grams of 77 micron volume median diameter irregular steel core (obtained from Hoeganaes), and 100 milliliters of ACS grade dichloromethane (Aldrich) are mixed in a 250 milliliter plastic bottle. The mixing is accomplished with a hand shaker for a period of 45 minutes. There results a uniform distribution of the attached polymer on the core as determined by visual observation. In the second step, the dichloromethane mixture containing the polymer and the carrier beads, with continuous air stirring, are brought to dryness by vacuum evaporation. This results in a continuous uniform polymer coating on the core. The final product is comprised of a carrier core with a total of approximately 90 percent surface coverage of the carrier core by the polymers, with the weight percent of the blended polymers, of poly[bis(2-(2-(2-methoxyethoxy)ethoxy)-ethoxy)propylsiloxane] (21) and polymethylmethacrylate, the weight percent being calculated (or calculatable throughout) as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Melt Preparation of Polysiloxane Additive in an MMA Polymer Carrier

EXAMPLE XVII

A carrier coated with 3:97 ratio of poly[bis(2-(2-(2-methoxyethoxy)ethoxy)-ethoxy)propylsiloxane] (21)/ polymethylmethacrylate is prepared as follows:

In the first step of the carrier coating process, 0.09 gram of poly[bis(2-(2-(2-methoxyethoxy)ethoxy)-ethoxy) propylsiloxane] (21) prepared as in Synthetic Example III and 2.91 grams of polymethylmethacrylate polymer along with 190 grams of 77 micron volume median diameter irregular steel core (obtained from Hoeganaes) are mixed in a 250 milliliter plastic bottle. The mixing is accomplished with a hand shaker for a period of 45 minutes. There results uniformly distributed and electrostatically attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymers, with the weight percent of the blended polymers, of poly[bis(2-(2-(2-methoxyethoxy) ethoxy)-ethoxy)propylsiloxane] (21) and polymethyl methacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Solution Preparation of Polysiloxane Additive in an MMA Polymer Carrier

EXAMPLE XVIII

A carrier coated with 3:97 ratio of poly[bis(2-(2-(2-methoxyethoxy)ethoxy)-ethoxy)propylsiloxane] (21)/ polymethylmethacrylate is prepared as follows:

In the first step of the carrier coating process, 0.09 gram of poly[bis(2-(2-(2-methoxyethoxy)ethoxy)-ethoxy) propylsiloxane] (21) prepared as in Synthetic Example III and 2.91 grams of polymethylmethacrylate polymer along with 190 grams of 77 micron volume median diameter irregular steel core (obtained from Hoeganaes), and 100 milliliters of ACS grade dichloromethane (Aldrich) are mixed in a 250 milliliter plastic bottle. The mixing is accomplished with a hand shaker for a period of 45 minutes. There results a uniform distribution of the attached polymer on the core as determined by visual observation. In the second step, the mixture is added to a single-drive batch melt mixing device (obtained from Haake) under the conditions of 5 rpm for a period of 30 minutes at a temperature of 205° C., thereby causing the polymer to melt and fuse to the core. This results in a continuous uniform polymer coating on the core. The final product is comprised of a carrier core with a total of approximately 90 percent surface coverage of the carrier core by the polymers, with the weight percent of the blended polymers, of poly[bis(2-(2-(2-methoxyethoxy)ethoxy)-ethoxy)propylsiloxane) (21) and polymethylmethacrylate, the weight percent being calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer is shaken on a paint shaker, and 0.3 gram samples are removed after 1 minute, 15 minutes, and 90 minutes. Thereafter, at each of these mixing times, the triboelectric charge on the carrier particles can be determined by the known Faraday Cage process. Further, the conductivity of the carrier as can be determined by forming a 0.1 inch long magnetic brush of the carrier particles, and measuring the conductivity by imposing a 10 volt potential across the brush is expected to be in the range of about $10^{-6}$ to about $10^{-8}$ (mho-cm)$^{-1}$. Therefore, these carrier particles would be considered conductive.

Synthetic Example 1

To a neat sample of hexachlorocyclotriphosphazene, 99 percent (100 grams, 0.402 mole) is added a small amount of a suitable Lewis acid initiator, such as $BCl_3$ (0.005 gram, $4\times10^{-4}$ mol), to a sealed ampoule that is heated to 250° C. for 3 to 4 hours or until the melt becomes immobile. The sealed ampoule is cooled, broken, and dissolved in 200 milliliters of dichloromethane. The monomeric material is separated by precipitation into an excess of hexanes. The polymer is recovered as a dry, hydroscopic powder that should not be exposed to air for long periods of time. The polymer is readily redissolved in solvents like dioxane and can be substituted with appropriate alkyl, aryl lithium or Grignard reagent, aryl or alkyl alkoxy metal salt, or any number of amino pendant groups. For example, the recovered polymer (90 grams) is redissolved in 250 milliliters of distilled, dried dioxane to which an excess of the sodium salt of trifluoromethylethanol (prepared from the reaction of (227.1 grams, 2.01 mol) trifluoromethylethanol with sodium metal (46 grams, 2.01 mol) in dried dioxane) is added. The reaction is allowed to stir at room temperature under an inert atmosphere for 24 hours. The substituted polymer, poly(bis-b-rifluoromethylethoxy)phosphazene (12), is recovered by precipitation into an excess of hexanes (3,000 milliliters), filtered and dried.

Synthetic Example 2

Preparation of Polyphosphazenes for use as Homopolymers, Blends or Additives in Carrier Coatings at Room Temperature from Lewis Acid Catalyzed Polymerization of Phosphoranimine Alternatively, the same above intermediate polymer can be prepared through a living cationic room temperature route involving the catalytic reaction of phosphorus pentachloride with trichloro(trimethylsilyl) phosphoranimine or related materials as taught by Manners et al., referenced herein.

A mixture of freshly distilled phosphoranimine (50 grams, 0.223 mol) and a small amount of phosphorous pentachloride (250 milligrams, $1.2\times10^{-4}$ mol) is added to large glass ampoule and sealed under vacuum. The mixture is allowed to stand at room temperature, about 25° C., for between 3 to 4 days. The mixture clears and forms two phases (the elimination of chlorotrimethylsilane) over this period and is deemed complete. The solution was evaporated to dryness and redissolved in dioxane. The polymer can be substituted with the appropriate alkyl, aryl lithium or Grignard reagent, aryl or alkyl alkoxy metal salt, or a number of amino pendant groups. For example, the recovered polymer (90 grams) is redissolved in 250 milliliters of distilled, dried dioxane to which an excess of the sodium salt of trifluoromethylethanol (prepared from the reaction of (227.1 grams, 2.01 mol) trifluoromethylethanol with sodium metal (46 grams, 2.01 mol) in dried dioxane) is added. The reaction is allowed to stir at room temperature under an inert atmosphere for 24 hours. The substituted polymer, poly(bis-b-trifluoromethylethoxy)phosphazene (12), is recovered by precipitation into an excess of hexanes (3,000 milliliters), filtered and dried.

Other embodiments and modifications of the present invention may occur to those of ordinary skill in the art subsequent to a review of the present application and the information presented herein; these embodiments, modifications, and equivalents, or substantial equivalents thereof, are also included within the scope of the present invention.

What is claimed is:

1. A carrier comprised of a core and thereover a polymer or mixture of polymers, and wherein the polymer or mixture of polymers contains a conductive inorganic polymer dispersed therein.

2. A carrier in accordance with claim 1 wherein said conductive polymer is a polyphosphazene.

3. A carrier in accordance with claim 1 wherein said conductive polymer is a polyphosphazene of poly (bismethoxyethoxyethoxy)phosphazene (1), poly(phenyl) (methoxyethoxyethoxy)phosphazene (2), poly(methyl) (methoxyethoxyethoxy)phosphazene (3), poly(methoxy) (methoxyethoxyethoxy)phosphazene (4), poly(phenoxy) (methoxyethoxyethoxy)phosphazene (5), poly (methylamino)(methoxyethoxyethoxy)phosphazene (6), poly(phenylamino)(methoxyethoxyethoxy)phosphazene (7), poly(bismethoxyethoxy) phosphazene (8), poly (bismethoxypropoxy)phosphazene (9), poly(bis-β-pentafluoroethylpropoxy)phosphazene (10), poly (bisphenoxy)phosphazene (11), poly(bis-β-trifluoromethylethoxy)phosphazene (12), poly(bis-4-phenylphenoxy)phosphazene (13), poly(bis[1,1]biphenyl-4-methoxy-4'-ethoxyethoxyethoxy)phosphazene (14), or poly (bismethoxy)phosphazene (15).

4. A carrier in accordance with claim 1 wherein said conductive polymer is a polyphosphazene of poly(bis-4-isopropylphenoxy)phosphazene (16), poly(2-methoxyethoxyethoxycarbo-4,4-methoxyethoxyethoxy-6,6-methoxyethoxyethoxy)phosphazene (17), poly(2-methoxyethoxyethoxy-thio-4,4-methoxyethoxyethoxy-6,6-methoxyethoxyethoxy)phosphazene (18), poly(2-methoxyethoxyethoxythionyl-4,4-methoxyethoxyethoxy-6,6-methoxyethoxyethoxy)phosphazene (19), or poly (methoxyethoxyethoxy)oxothiazene (20).

5. A carrier in accordance with claim 1 wherein the conductive polymer coating weight thereof is from about 0.1 to about 20 weight percent.

6. A developer comprised of the carrier of claim 1 and toner.

7. A developer in accordance with claim 6 wherein the toner is comprised of thermoplastic resin and colorant.

8. A process for the preparation of the carrier of claim 1 by the dry mixing and heating of said core, said polymer or mixtures of polymers and said conductive polymer.

9. A carrier in accordance with claim 1 wherein the core is powdered steel, or a strontium ferrite, and optionally wherein the carrier is of an average diameter of from about 50 to about 125 microns.

10. A carrier in accordance with claim 1 wherein the polymer is a polyurethane/polyester, a styrene based polymer, a polymethylmethacrylate, or a fluorocarbon polymer.

11. A carrier in accordance with claim 1 wherein said conductive polymer is a polyphosphazene of poly(bis(methoxyethoxyethoxy)phosphazene (1), poly(phenyl)(methoxyethoxyethoxy)phosphazene (2), poly(methyl)(methoxy ethoxyethoxy)phosphazene (3), poly(methoxy)(methoxyethoxyethoxy)phosphazene (4), poly(phenoxy)(methoxyethoxy ethoxy)phosphazene (5), poly(methylamino)(methoxyethoxyethoxy)phosphazene (6), poly(phenylamino)(methoxyethoxyethoxy)phosphazene (7), poly(bismethoxyethoxy)phosphazene (8), poly(bismethoxypropoxy)phosphazene (9), poly(bis-β-pentafluoroethylpropoxy)phosphazene (10), poly(bisphenoxy)phosphazene (11), poly(bis-β-trifluoromethylethoxy)phosphazene (12), poly(bis-4-phenylphenoxy)phosphazene (13), poly(bis[1,1]biphenyl-4-methoxy-4'-ethoxyethoxyethoxy)phosphazene (14), or poly(bismethoxy)phosphazene (15); a polyphosphazene of poly[bis-4-isopropylphenoxy)phosphazene] (16), poly(2-methoxyethoxyethoxycarbo-4,4-methoxyethoxyethoxy-6,6-methoxyethoxyethoxy)phosphazene (17), poly(2-methoxyethoxyethoxy-thio-4,4-methoxyethoxyethoxy-6,6-methoxy ethoxyethoxy)phosphazene (18), poly(2-methoxyethoxyethoxythionyl-4,4-methoxyethoxyethoxy-6,6-methoxyethoxyethoxy)phosphazene (19), (poly(methoxyethoxyethoxy)oxothiazene (20); or a polysiloxane of poly[(2-(2-(2-methoxyethoxy)ethoxy)-ethoxy)propyl alkyl siloxane] (21), poly[methyl(2-(2-(2-methoxyethoxy)ethoxy)-ethoxy)propyl alkyl siloxane] (22), poly[ethyl(2-(2-(2-methoxyethoxy)ethoxy)-ethoxy)propyl alkyl siloxane] (23), poly[propyl(2-(2-(2-methoxyethoxy)ethoxy)-ethoxy)propyl alkyl siloxane] (24), or poly[phenyl(2-(2-(2-methoxyethoxy)ethoxy)-ethoxy)propyl alkyl siloxane] (25).

12. A carrier in accordance with claim 1 wherein said conductive inorganic polymer is a polyphosphazene or a polysiloxane of the formula

1

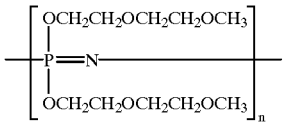

2

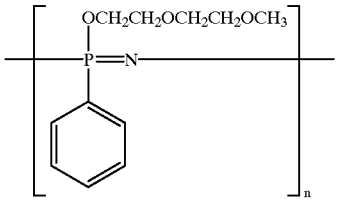

-continued

3

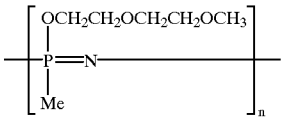

4

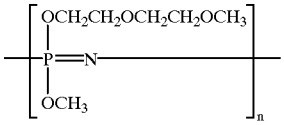

5

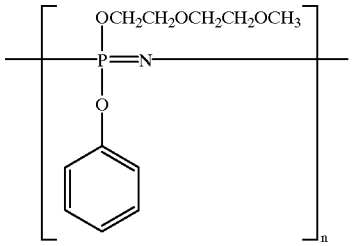

6

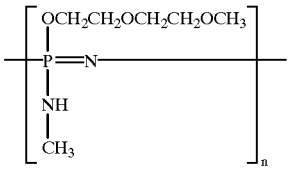

7

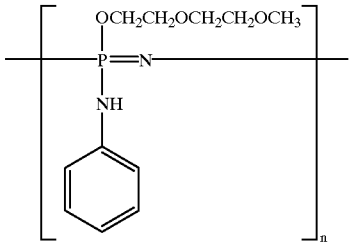

8

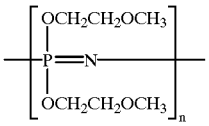

9

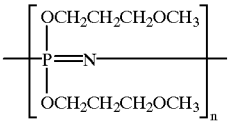

10

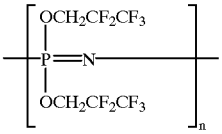

-continued

11

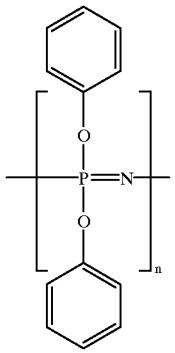

12

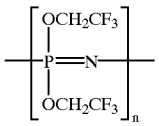

13

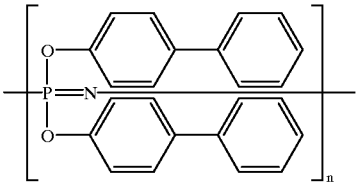

14

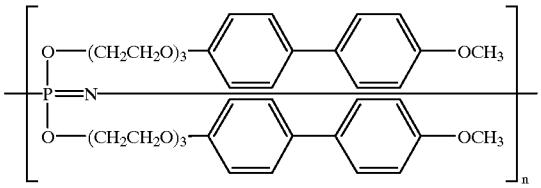

15

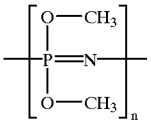

16

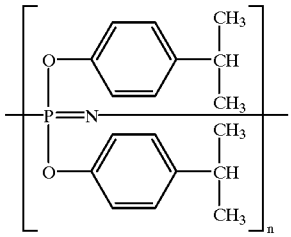

17

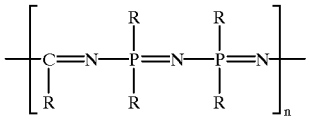

where R = $(OCH_2CH_2)_2OCH_3$

-continued

18

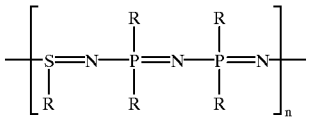

where R = $(OCH_2CH_2)_2OCH_3$ or

19

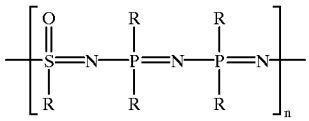

where R = $(OCH_2CH_2)_2OCH_3$ and wherein n represents the number of repeating units.

13. A carrier comprised of a core and thereover a conductive polymer, and wherein said polymer is poly (bismethoxyethoxyethoxy)phosphazene (1), poly(phenyl) (methoxyethoxyethoxy)phosphazene (2), poly(methyl) (methoxyethoxyethoxy)phosphazene (3), poly(methoxy) (methoxyethoxyethoxy)phosphazene (4), poly(phenoxy) (methoxyethoxyethoxy)phosphazene (5), poly (methylamino)(methoxyethoxyethoxy)phosphazene (6), poly(phenylamino)(methoxyethoxyethoxy)phosphazene (7), poly(bismethoxyethoxy)phosphazene (8), poly (bismethoxypropoxy)phosphazene (9), poly(bis-β-pentafluoroethylpropoxy)phosphazene (10), poly (bisphenoxy)phosphazene (11), poly(bis-β-trifluoromethylethoxy)phosphazene (12), poly(bis-4-phenylphenoxy)phosphazene (13), poly(bis[1,1]biphenyl-4-methoxy-4'-ethoxyethoxyethoxy)phosphazene (14), poly (bismethoxy)phosphazene (15), poly(bis-4-isopropylphenoxy)phosphazene (16), poly(2-methoxyethoxyethoxycarbo-4,4-methoxyethoxyethoxy-6,6-methoxyethoxyethoxy)phosphazene (17), poly(2-methoxyethoxyethoxy-thio-4,4-methoxyethoxyethoxy-6,6-methoxyethoxyethoxy)phosphazene (18), poly(2-methoxyethoxyethoxythionyl-4,4-methoxy ethoxyethoxy-6,6-methoxyethoxy ethoxy) phosphazene (19), poly (methoxyethoxyethoxy)oxothiazene (20), poly[(2-(2-(2-methoxyethoxy)ethoxy)-ethoxy)propyl alkyl siloxane] (21), poly[methyl(2-(2-(2-methoxyethoxy)ethoxy)-ethoxy)propyl alkyl siloxane] (22), poly[ethyl(2-(2-(2-methoxyethoxy) ethoxy)-ethoxy)propyl alkyl siloxane] (23), poly[propyl(2-(2-(2-methoxyethoxy)ethoxy)-ethoxy)propyl alkyl siloxane] (24), or poly[phenyl(2-(2-(2-methoxyethoxy)ethoxy)-ethoxy)propyl alkyl siloxane] (25).

14. A carrier in accordance with claim 13 wherein the conductive polymer possesses an $M_w$ weight average molecular weight of from about 5,000 to about 1,000,000, and an $M_n$ number average molecular weight of from about 12,000 to about 1,000,000.

15. A carrier in accordance with claim 13 wherein the conductive polymer possesses a glass transition temperature Tg of from about 120° C. to about 200° C., or wherein the conductive polymer Tg is from about 60° C. to about 80° C.

16. A carrier in accordance with claim 13 wherein said conductive polymer is selected in an amount of from about 10 to about 60 weight percent.

17. A carrier in accordance with claim 13 wherein said core is a metal, a metal oxide, or a ferrite.

18. A carrier in accordance with claim 13, wherein the carrier contains a further polymer coating, or mixtures of polymers.

19. A carrier in accordance with claim 18 wherein said further polymer is a styrene acrylate, a styrene methacrylate, a fluoropolymer, or a polyurethane, and which polyurethane optionally contains dispersed therein conductive components.

20. A carrier in accordance with claim 13 wherein said polymer possesses a weight average molecular weight of from about 15,000 to about 500,000, and number average molecular weight $M_n$ of from about 7,000 to about 220,000.

21. A carrier comprised of a core and thereover a polymer or mixture of polymers, and wherein the polymer or mixtures of polymers contains a conductive inorganic polymer dispersed therein, and wherein said conductive polymer is a phosphazene of poly(bismethoxyethoxyethoxy) phosphazene (1), poly(phenyl)(methoxyethoxyethoxy) phosphazene (2), poly(methyl)(methoxyethoxyethoxy) phosphazene (3), poly(methoxy)(methoxyethoxyethoxy) phosphazene (4), poly(phenoxy)(methoxyethoxyethoxy) phosphazene (5), poly(methylamino)(methoxyethoxyethoxy)phosphazene (6), poly(phenylamino) (methoxyethoxyethoxy)phosphazene (7), poly (bismethoxyethoxy)phosphazene (8), poly (bismethoxypropoxy)phosphazene (9), poly(bis-β-pentafluoroethylpropoxy)phosphazene (10), poly (bisphenoxy)phosphazene (11), poly(bis-β-trifluoromethylethoxy)phosphazene (12), poly(bis-4-phenylphenoxy)phosphazene (13), poly(bis[1,1]biphenyl-4-methoxy-4'-ethoxyethoxyethoxy)phosphazene (14), or poly (bismethoxy)phosphazene (15).

22. A carrier comprised of a core and thereover an inorganic conductive polymer, and wherein said conductive polymer is a polyphosphazene of poly(bis-4-isopropylphenoxy)phosphazene (16), poly(2-methoxyethoxyethoxycarbo-4,4-methoxyethoxyethoxy-6,6-methoxyethoxyethoxy)phosphazene (17), poly(2-methoxyethoxyethoxy-thio-4,4-methoxy ethoxyethoxy-6,6-methoxyethoxyethoxy)phosphazene (18), poly(2-methoxyethoxyethoxythionyl-4,4-methoxyethoxyethoxy-6,6-methoxyethoxyethoxy)phosphazene (19), or poly (methoxyethoxyethoxy)oxothiazene (20).

23. A carrier comprised of a core and thereover a polymer or mixture of polymers, and wherein the polymer or mixture of polymers contains a conductive inorganic polymer dispersed therein, and wherein said conductive polymer is

1

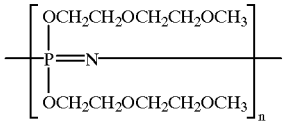

2

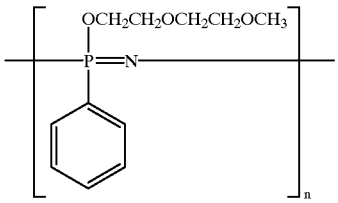

-continued

3

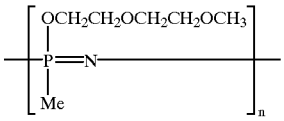

4

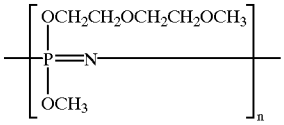

5

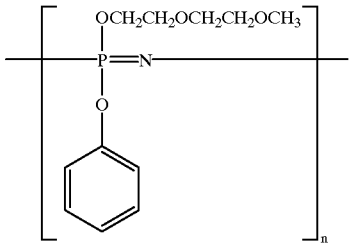

6

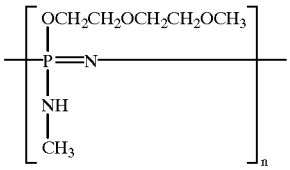

7

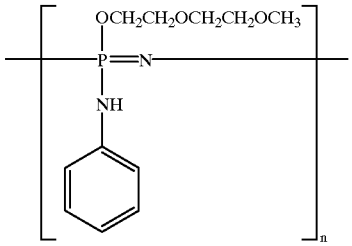

8

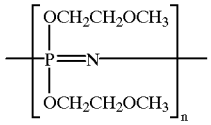

9

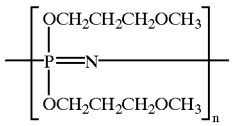

10

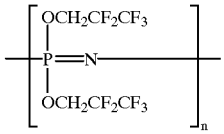

-continued
11
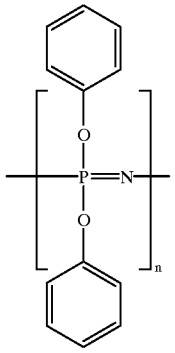
12
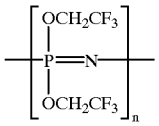
13
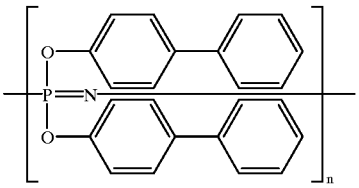
14
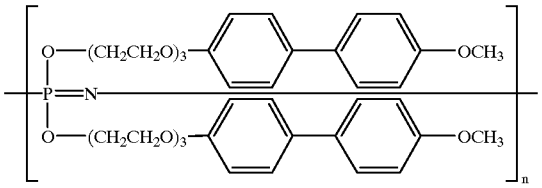
15
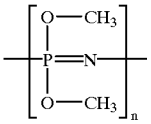
16
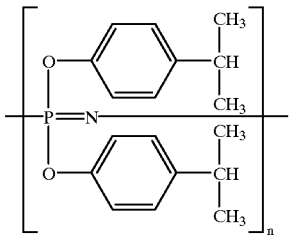
-continued
17
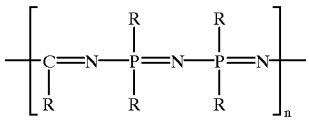
where R = $(OCH_2CH_2)_2OCH_3$
18
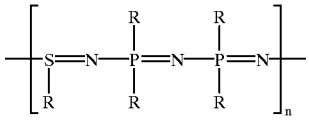
where R = $(OCH_2CH_2)_2OCH_3$
19
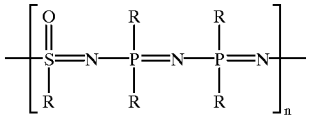
where R = $(OCH_2CH_2)_2OCH_3$
20
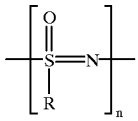
where R = $(OCH_2CH_2)_2OCH_3$
21
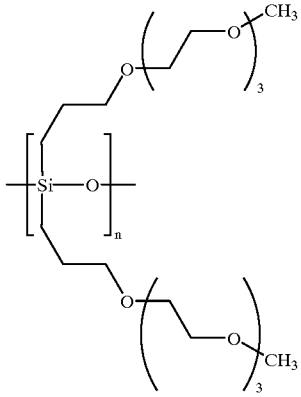
22
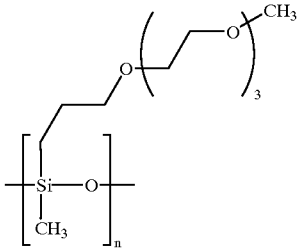
23
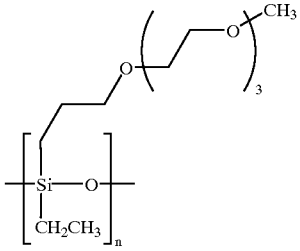

-continued
24
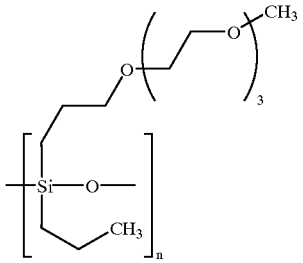
25
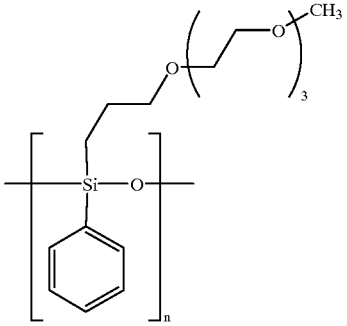
or
26
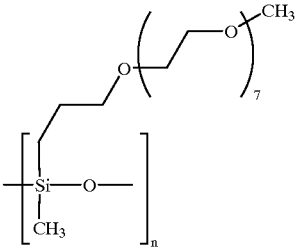
and wherein n represents the number of repeating segments.
24. A carrier comprised of a core and thereover a conductive polymer and wherein said conductive polymer is of the following formula
21
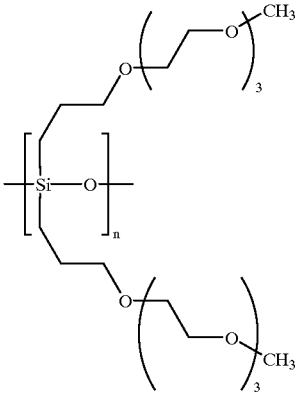
-continued
22
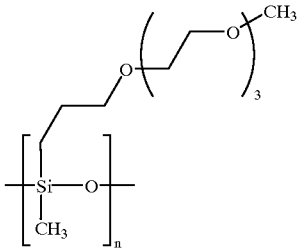
23
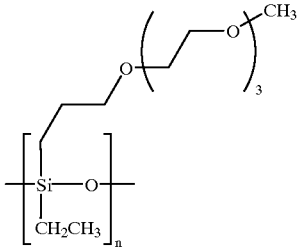
24
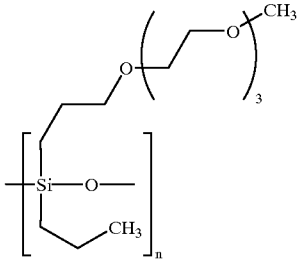
25
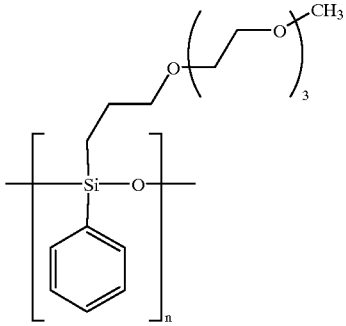
or
26
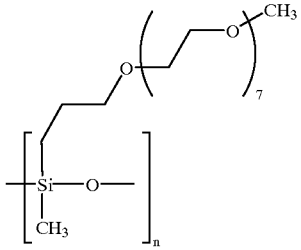
and wherein n represents the number of repeating units.
* * * * *